United States Patent [19]

Bergeson et al.

[11] 4,064,414

[45] Dec. 20, 1977

[54] APPARATUS FOR SIMULATING THE LIGHT PRODUCED BY A FIRE

[75] Inventors: Haven E. Bergeson; Mark W. Fuller, both of Salt Lake City, Utah

[73] Assignee: FBW Enterprises, Salt Lake City, Utah

[21] Appl. No.: 764,396

[22] Filed: Jan. 31, 1977

[51] Int. Cl.[2] ..... H05B 37/02; H05B 41/44

[52] U.S. Cl. ..... 315/208; 315/200 R; 315/199; 315/291

[58] Field of Search ..... 315/208, 200 R, 199

[56] References Cited

U.S. PATENT DOCUMENTS

| | | | |
|---|---|---|---|
| 3,500,126 | 3/1970 | Ford | 315/209 R |
| 3,506,876 | 4/1970 | Antonich | 315/200 R |
| 3,710,182 | 1/1973 | Van Reenen | 315/200 R X |

*Primary Examiner*—Alfred E. Smith
*Assistant Examiner*—Charles F. Roberts
*Attorney, Agent, or Firm*—Criddle, Thorpe & Western

[57] ABSTRACT

Fire simulating apparatus includes a random number generator, a digital-to-analog converter for converting the output of the random number generator to an analog signal, a lamp coupled to a power source, a switching device coupled in series with the lamp and power source, and a control circuit for controlling the conductivity of the switching device in accordance with the magnitude of the analog signal.

20 Claims, 2 Drawing Figures

APPARATUS FOR SIMULATING THE LIGHT PRODUCED BY A FIRE

BACKGROUND OF THE INVENTION

This invention relates to apparatus for controlling the application of power to a light source to thereby simulate the light output of a flame or fire.

Simulation of a fire or flame (or light which randomly varies in intensity) is desired for a variety of situations including production of the appearance of fire for stage plays and movies, production of light having the appearance of a burning log for artificial fireplaces, production of a flickering light effect for artificial candles, and production of various lighting effects for discotheques and similar places of entertainment. A number of arrangements have been proposed for simulating a fire or flame but most such arrangements provide for a periodic rather than truly random control of the light output. As a result, the lighting effect, although having a flickering appearance, does not truly simulate the random flickering of a fire or flame. Further, most such arrangements have few controls for controlling such characteristics as the average flicker rate and average light intensity. Finally, most such prior art arrangements are adapted for use only with an A.C. power supply. Examples of prior art apparatus are disclosed in U.S. Pat. Nos. 3,506,876, 3,710,182 and 3,500,126.

SUMMARY OF THE INVENTION

It is an object of the present invention to provide new and improved apparatus for controlling application of power to a lamp to thereby simulate the light output of a fire or flame.

It is another object of the present invention to provide random control of the application of power to a lamp.

It is still another object of the present invention to provide such apparatus having multiple controls of the light intensity and flicker rate produced.

It is a further object of the present invention, in accordance with one aspect thereof, to provide apparatus for controlling the application of direct current to a lamp to simulate the light output of a fire or flame.

These and other objects of the present invention are realized in a specific illustrative embodiment which includes a random number generator, a digital-to-analog converter for converting the digital output of the generator to an analog signal, a lamp coupled to a power supply, a controllable switching device coupled in series with the lamp and power supply, and a control circuit for controlling the conduction of the switching device in accordance with the magnitude of the analog signal to thereby control the application of power to the lamp.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
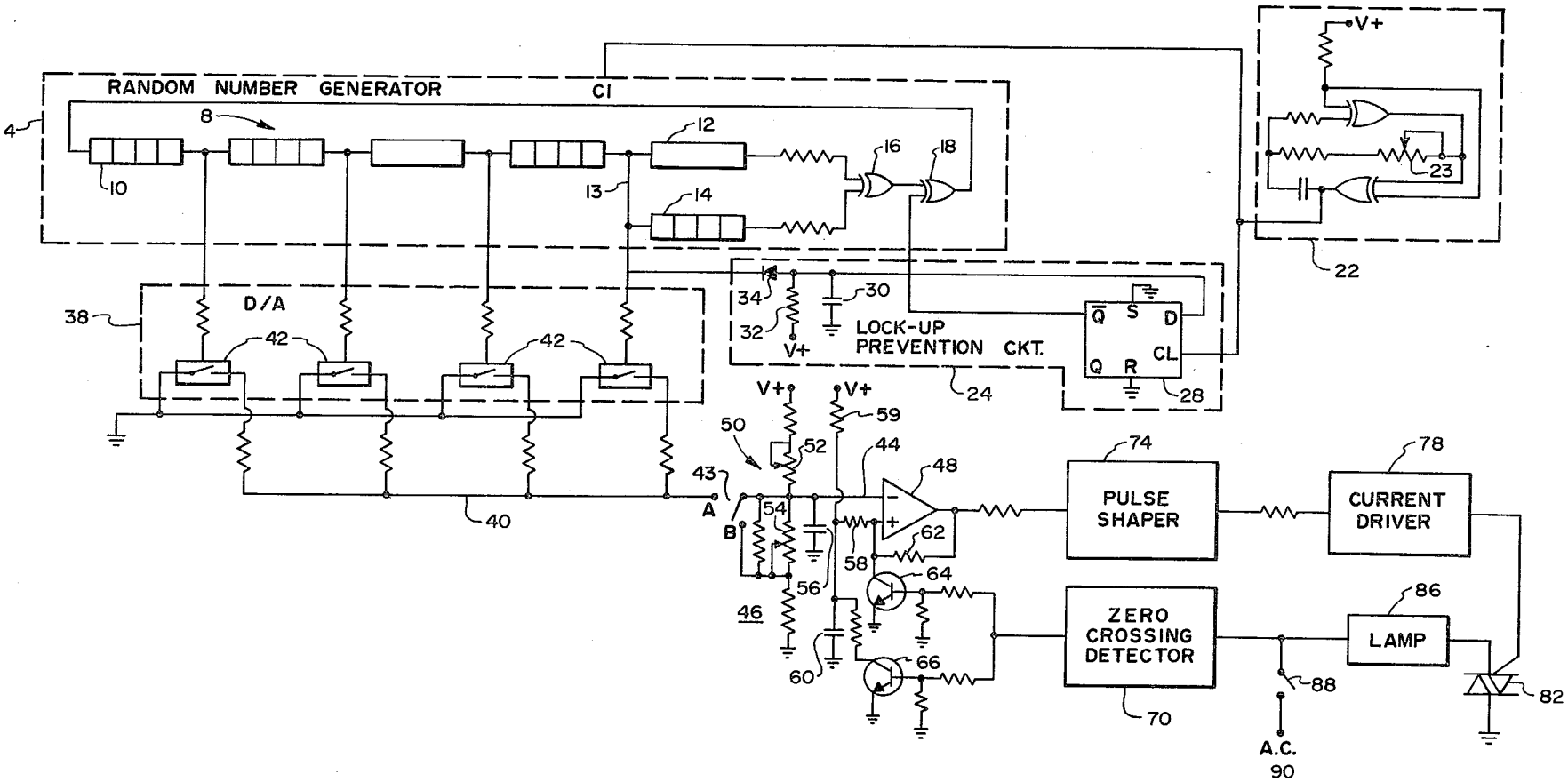
FIG. 1 is a circuit schematic of apparatus made in accordance with the principles of the present invention and adapted for use with an A.C. power supply.
Figure 2:
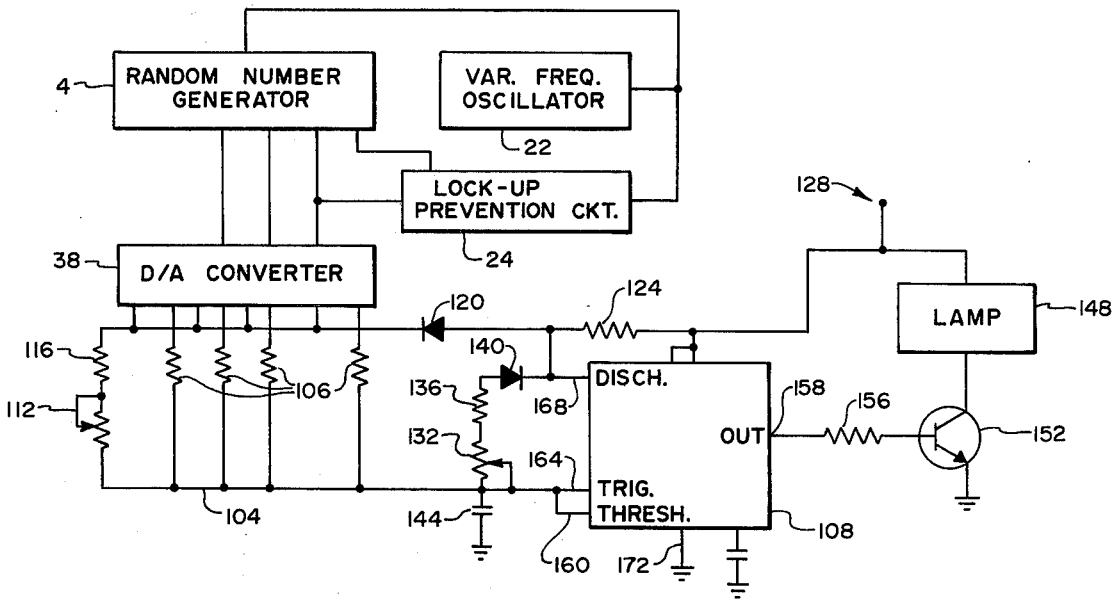
FIG. 2 is a circuit schematic of apparatus of the present invention adapted for use with a D.C. power supply.

The two embodiments of the present invention shown in the drawings both use a random number generator (or more accurately a pseudo-random number generator since the generator will repeat itself over a very long period) shown in detail in FIG. 1 and in block diagram form in FIG. 2. In FIG. 1 the random number generator is shown at 4 having a multiple-stage shift register 8. Digital information is introduced into the shift register at an input end or stage 10 and shifted to the right thereof ultimately to a single stage output 12 and a four stage output 14 located at an output end of the shift register. The outputs of the stages 12 and 14 are supplied to an Exclusive-Or gate 16 whose output is supplied to another Exclusive-or gate 18. The output of the Exclusive-Or gate 18 is supplied to the input end 10 of the shift register 8.

A conventional variable frequency oscillator 22 supplies an oscillatory signal to clock the random number generator 4 to shift the contents of the shift register 8. That is, with each oscillation of the oscillatory signal from the variable frequency oscillator 22, the random number generator 4 is caused to shift the contents of the shift register one stage to the right. The output of the variable frequency oscillator 22 is also supplied to a lock-up prevention circuit 24 and in particular to clock a D-type flip-flop 28. The flip-flop 28 supplies either a logical "0" or "1" to the Exclusive-Or gate 18 depending upon the state of the flip-flop. The D input to the flip-flop 28 is coupled to a capacitor 30, to a resister 32 which is coupled to a voltage source, and to the anode of a diode 34. The cathode of the diode 34 is coupled to the output line of one of the intermediate stages of the shift register 8. The function of the lock-up prevention circuit 24 will be discussed later.

Outputs from various stages of the shift register 8 are supplied to a digital-to-analog converter 38 which converts the digital information represented on the outputs into an analog signal supplied to line 40, where the magnitude of the signal is generally proportional to the value of the digital information supplied by the random number generator 4. The digital-to-analog converter 38 is a conventional device which includes a plurality of analog switches 42 which are caused to open if the corresponding bit received from the random number generator 4 is a "0" and to close if the corresponding bit is a "1" (or vice versa). The number of such switches which are closed determines the magnitude of the analog signal produced on lead 40.

Lead 40 is coupled by way of a switch 43 to an inverting input 44 of a Schmitt trigger 48 of a control circuit 46. Also coupled to the input 44 is a voltage divider circuit 50 comprised of a potentiometer 52 coupled to a voltage source, and a potentiometer 54 coupled to ground potential. A capacitor 56 is also coupled to the inverting input 44. Coupled to the non-inverting input of the Schmitt trigger 48 is a resister 58 which, in turn, is coupled to a capacitor 60, and by way of another resister 59 to a voltage source. The output of the Schmitt trigger 48 is coupled by way of a resister 62 to the non-inverting input thereof and also to the collector of a transistor 64. The base of the transistor 64 is coupled by way of a resister to a zero crossing detector circuit 70. The collecter of a second transistor 66 is coupled by way of a resister to the junction between the resister 58 and the capacitor 60, and the base of the transistor 66 is coupled by way of a resister also to the zero crossing detector circuit 70. The emitters of the transistors 64 and 66 are each coupled to ground potential.

The output of the Schmitt trigger is supplied via a resister to a pulse shaper circuit 74 whose output, in turn, is supplied by way of another resister to a current driver circuit 78. The current driver circuit is coupled to the gate or control electrode of a triac 82. The two power electrodes of the triac 82 are coupled in series between ground potential and a lamp 86 and this combination, in turn, is coupled by way of a switch 88 in series with an A.C. power supply 90. The zero crossing detector 70 is also coupled by way of the switch 88 to the A.C. power supply 90.

In operation, the random number generator 4 successively produces digital signals which randomly vary in value. As already indicated, the contents of the shift register 8 are shifted to the right with each oscillation of the variable frequency oscillator 22. The outputs of the output stages 12 and 14 of the shift register are supplied to the Exclusive-Or gate 16 which produces a "1" output if the inputs thereto are either both "0" or both "1", and produces a "0" output if the inputs thereto are different from each other. The Exclusive-Or gate 18 operates in the same fashion from inputs received from the Exclusive-Or gate 16 and the flip-flop 28.

The lock-up prevention circuit 24 is provided to prevent a so-called lock-up of the shift register 8 in a state which cannot be changed. If, for example, the random number generator 4 were turned on to a state in which the contents of the shift register 8 were all "1's" then no amount of shifting of these contents would produce anything other than all "1's" if the circuit 24 were not provided. With provision of the lock-up prevention circuit 24, when the shift register came on in the all "1" state, the digital signal applied to a line 13 connected to the circuit 24 would be a logical "1", and this would back bias the diode 34. The capacitor 30 would thus charge from voltage supplied via resister 32 and when the capacitor reached a certain level, the flip-flop 28 would change states upon being clocked by the variable frequency oscillator 22 so that the output of the flip-flop supplied to the Exclusive-Or gate 18 would be a logical "0". With a logical "1" output from the Exclusive-Or gate 16 and a logical "0" output from the flip-flop 28, the Exclusive-Or gate 18 would supply a logical "0" to the input end 10 of the shift register and this would result in the desired change of state (from all "1's") of the shift register. Thereafter, the contents of the shift register 8 would always include "0's".

The varying digital values produced by the random number generator 4 are supplied to the digital-to-analog converter 38 which thereby controls the magnitude of the analog signal produced on lead 40. Voltage to this lead is supplied via potentiometer 52 from the voltage source V+ (when switch 43 is in position "A"). The magnitude of the analog signal on lead 40, i.e., the value of the voltage on lead 40, provides a reference input to the Schmitt trigger 48. When the voltage on the non-inverting input to the Schmitt trigger 48 is less than this voltage, then the Schmitt trigger produces no output signal (or low level output signal). The voltage signal supplied to the non-inverting input of the Schmitt trigger 48 is determined by the charge on the capacitor 60. The capacitor 60 is charged via a resister 59 by a positive voltage source V+ and when the charge on the capacitor increases to a level such that the input voltage to the non-inverting input of the Schmitt trigger 48 exceeds the voltage on the inverting input, the Schmitt trigger produces a positive going signal which is supplied to the pulse shaper circuit 74. This pulse shaper circuit 74, which may simply be a one-shot multivibrator, shapes the signal for application to the current driver circuit 78. The current driver circuit 78 in turn applies a control signal to the control electrode of the triac 82 to thereby cause the triac to conduct current. Assuming the switch 88 is in the closed position, A.C. power is supplied to the lamp 86 to turn on the lamp.

The zero crossing detector circuit 70, which is connected to the A.C. power supply 90, supplies a pulse to the base electrodes of the transistor 64 and 66 each time the power from the power supply crosses the zero voltage point. This pulse from the zero crossing detector circuit 70 causes the transistors to turn on and, in the case of transistor 66, discharge the capacitor 60. The voltage level on the non-inverting input of the Schmitt trigger terminates application of its output signal to the pulse shaper circuit 74. The triac 82, at the next zero crossing, thus becomes nonconductive so that no power is supplied to the lamp 86, at least during the initial portion of the next half cycle. The capacitor 60 again begins to charge and when it is charged to a certain level, the Schmitt trigger 48 again produces an output signal which ultimately activates the triac 82 so that power is supplied to the lamp 86.

It is apparent that the point in time in each half cycle of the A.C. power at which the triac 82 is caused to conduct is determined by the reference voltage level supplied to the inverting input of the Schmitt trigger 48. If this reference voltage level is low, then its value will be exceeded quite early in each half cycle by the charge on the capacitor 60 whereas if the reference voltage level on the inverting input is fairly high, then it will not be exceeded, if at all, until very late in each half cycle. Since the voltage level supplied to the inverting input varies randomly, the phase angle in each half cycle at which the triac 82 is caused to conduct also varies randomly.

The frequency of the oscillatory signal produced by the variable frequency oscillator 22 will normally be selected to be considerably lower than the frequency of the A.C. power supply. Thus, the triac 82 will be activated a number of times between each change of the contents of the random number generator 4 and thus between each change of the magnitude of the analog signal produced on lead 40. The flicker of the lamp 86 occurs because of the variation in intensity of the lamp and the flicker rate is simply the rate at which variations in intensity occur. Thus, the flicker rate of the lamp 86 may be varied simply by varying the frequency of the oscillatory output of the oscillator 22, i.e., setting a potentiometer 23 which controls the frequency oscillation. Varying such frequency varies the rate at which the random number generator 4 changes states to thus cause a change in the magnitude of the voltage supplied to the inverting input of the Schmitt trigger 48.

The intensity of the lamp 86 is determined by the amount of time during each half cycle that power is being supplied to the lamp 86. If the time is increased, then the lamp 86 has a greater intensity and vice versa. Thus, in order to increase the intensity of the lamp 86 (i.e., the average or range of intensity, since the intensity will still vary with variation in the voltage or lead 40), potentiometers 52 and 54 may be adjusted to generally decrease the voltage level on the inverting input 44 so that this value is generally exceeded sooner in each half cycle to cause the triac 82 to conduct. Of course, the voltage level on the inverting input will still vary but the range of variation will be shifted downwardly and so the range of intensity of the lamp 86 will be higher. Potentiometer 52 allows control of the upper limit of the voltage level on lead 40, while potentiometer 54 allows control of the lower limit of the voltage level. These controls, as well as the control of the flicker rate previously discussed, give considerable flexibility in selecting the type of fire simulation desired.

The apparatus of FIG. 1 may be made to function simply as a light dimmer by setting the switch 42 in position "B" which removes the digital-to-analog converter 38 and the potentiometer 54 from affecting the voltage on the inverting input 44. Then the lamp 86 will be supplied with a non-varying average current except that the magnitude of the average current and thus the intensity of the lamp, can be controlled manually by appropriate setting of the potentiometer 52.

As indicated earlier, the embodiment of FIG. 2 also utilizes a random number generator 4, variable frequency oscillator 22, lock-up prevention circuit 24 and digital-to-analog converter 38. The outputs of the digital-to-analog converter 38 are coupled to a lead 104 which is connected to a logic circuit 108. The lead 104 is also coupled via a potentiometer 112, a resistor 116, a diode 120, and another resister 124 to a positive current source 128. Coupled between the lead 104 and the logic circuit 108 is a series connection of a potentiometer 132, a resistor 136 and a diode 140. Finally, a capacitor 144 is also coupled to lead 104.

The current source 128 is coupled to a lamp 148 which is adapted to produce light whose intensity is dependent upon the amount of current supplied by the voltage source. The emitter-collector circuit of a transistor 152 is coupled in series with the lamp 148 and the current source 128. The base electrode of the transistor 152 is coupled via resistor 156 to an output terminal 158 of the logic circuit 108.

The random number generator 4, variable frequency oscillator 22, lock-up prevention circuit 24 and digital-to-analog converter 38 all operate in the manner described earlier in connection with FIG. 1 to produce an analog signal on lead 104 whose magnitude varies in accordance with the value of the numbers generated by the random number generator. In particular, current is supplied by the current source 128 via the resistor 124 and diode 120 to the digital-to-analog converter 38 which then applies this current, or a portion thereof, via certain ones of the resisters 106 to the lead 104. Current is also applied via resister 116 and the potentiometer 112 to the lead 104. The current supplied to lead 104 is generally proportional to the digital data produced by the random number generator 4.

The current applied to the lead 104 charges the capacitor 144 at a rate dependent upon the magnitude of this current. When the charge on the capacitor 144 reaches a certain upper level, the logic circuit 108 detects this at input terminal 160 and in response thereto coupled another input terminal 168 to a ground terminal 172 to provide a discharge path for the capacitor 144. This discharge path is from the capacitor 144 via the potentiometer 132, resister 136 and diode 140 to the ground terminal 172. In addition to coupling the input terminal 168 to the ground terminal 172 when the charge on the capacitor 144 reaches a certain upper level, the logic circuit 108 also terminates application of enabling control current to its output terminal 158. This results in the transistor 152 turning off thereby terminating application of current to the lamp 148. The logic circuit 108 might illustratively be timing circuitry such as the No. 555 timer produced by Signetics, Inc. and others.

When the charge on the capacitor 144 drops to a certain lower level, this is detected by an input terminal 164 of the logic circuit 108 and the logic circuit decouples the connection of the input terminal 168 from the ground terminal 172 to terminate further discharge of the capacitor 144. The logic circuit 108 also applies enabling control current to its output terminal 158 to turn on the transistor 152 and allow application of current to the lamp 148. The cycle of successively charging and discharging the capacitor 144 and of applying control current to the transistor 152 occurs numerous times between each change of the magnitude of the analog signal or current on lead 104.

When the current on lead 104 is increased, then the capacitor 144 charges more rapidly to reach a level where the enabling control current will be removed from the transistor 152. Thus, the portion of time that current will be supplied to the lamp 148 will be reduced. On the other hand, when the current on lead 104 is lowered, then the capacitor 144 charges less rapidly so that it takes longer to reach the level at which the enabling current will be removed from the transistor 152. Then, the amount of time that current is supplied to the lamp 148 is increased. It will be recognized that the current supplied to the lamp 148 will be in the form of a pulsating current.

The average level of the analog signal or current on lead 104 can be changed by appropriate adjustment of the potentiometer 112. In particular, by decreasing the resistance of the potentiometer 112, the average level of the current on lead 104 can be increased and by increasing the resistance of the potentiometer, the average level can be decreased. Of course, the level on lead 104 will change with each change in the output of the digital-to-analog converter 38, but the average or mid-level of the current can be varied by manual adjustment of the potentiometer 112. Potentiometer 132 is provided to enable manual control of the rate of discharge of the capacitor 144.

The embodiments shown and described in FIGS. 1 and 2 provide extremely versatile systems for simulating the light produced by a fire by enabling control of various characteristics of the light such as flicker rate and general intensity.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is

1. Apparatus for controlling the application of electrical current from a power source to a lamp to simulate the light output of a fire comprising random number generating means for successively producing randomly varying digital signals in response to an oscillatory signal, with the rate of producing the digital signals being determined by the frequency of the oscillatory signal, oscillator means for applying an oscillatory signal to said random number generating means, said oscillator means including manually adjustable means by which the frequency of the oscillator signal may be varied, digital-to-analog converter means coupled to said random number generating means for producing an analog signal whose magnitude is generally proportional to the value of the digital signals produced by the random number generating means, lamp means coupled to the power source for producing light when current is applied thereto, a switching device having a pair of power electrodes connected in series with the lamp means and power source, and having a control electrode, and control means responsive to said analog signal for applying a control signal to the control electrode of said switching device to thereby cause the switching device to conduct current between the power electrodes thereof to apply current to the lamp means, the amount of current conducted being determined by the magnitude of said analog signal

2. Apparatus as in claim 1 further including a voltage divider means coupled between said digital-to-analog converter means and said control means, said voltage divider means including manually adjustable means for varying the magnitude of the analog signal to thereby vary the average intensity of the light produced by the lamp.

3. Apparatus as in claim 2 wherein said control means includes capacitor means chargeable from a D.C. voltage source, means for periodically discharging said capacitor means, and means coupled to said capacitor means for applying the control signal to the control electrode of said switching device when the charge on said capacitor means is at a certain level, the time for the capacitor means to charge to said certain level being determined by the magnitude of said analog signal.

4. Apparatus as in claim 1 wherein said random number generating means includes a multi-stage shift register responsive to said oscillatory signal for shifting its contents to produce a digital signal with each oscillation of the oscillatory signal, said shift register including an input stage, a pair of output stages, and a plurality of intermediate stages from which digital signals are received by the output stages, logic means for producing a digital output signal in response to digital input signals applied thereto, the value of said digital output signal being determined by said input signals, means for applying the contents of said pair of output stages to said logic means, means for applying the output signal produced by said logic means to said input stage, and detection means coupled to an intermediate stage of said shift register for applying a digital signal to said logic means if a certain number of consecutive digital signals of a certain kind are shifted from the intermediate stage.

5. Apparatus as in claim 4 wherein said logic means comprises a first Exclusive-Or gate having two inputs, each connected to the output of a different one of said output stages, and a second Exclusive-Or gate having two inputs, one of which is connected to the output of said first Exclusive-Or gate and the second of which is connected to receive the digital signal from said detection means, the output of said second Exclusive-Or gate being connected to said input stage.

6. Apparatus as in claim 5 wherein said detection means comprises a diode whose cathode is coupled to said intermediate stage, said diode being back biased when digital signals of said certain kind are shifted from the intermediate stage, a voltage source coupled to the anode of said diode, a capacitor coupled to the anode of said diode for charging when the diode is back-biased, and a bistable element responsive to the capacitor charging to a certain voltage level for producing the digital signal for application to said second Exclusive-Or gate.

7. Apparatus for controlling the application of power from an A.C. source to a lamp to simulate the light output of a fire comprising random number generating means for successively producing digital signals which randomly vary in value, digital-to-analog converter means coupled to said random number generating means for producing an analog signal whose magnitude is generally proportional to the value of the digital signals produced by the random number generating means, lamp means for producing light when current is applied thereto, a switching device having a pair of power electrodes connected in series with the lamp means and A.C. source, and having a control electrode, zero voltage crossing detector means coupled to the A.C. source for producing a crossover signal each time the power from the A.C. source crosses the zero voltage point, and control means coupled to said digital-to-analog converter means and said zero voltage crossing detector means for applying a control signal to the control electrode of said switching device to thereby cause the switching device to conduct current, said control means being adapted to terminate application of the control signal to the control electrode of said switching device each time a crossover signal is produced and to apply the control signal to the control electrode a period of time thereafter, which period varies with variation in the magnitude of said analog signal.

8. Apparatus as in claim 7 wherein said control means includes capacitor means chargeable from a D.C. voltage source, means coupled to said zero voltage crossing detector means for discharging said capacitor means each time a crossover pulse is produced, and comparator means for producing said control signal when the charge on said capacitor means reaches a certain value relative to the magnitude of said analog signal.

9. Apparatus as in claim 8 wherein said comparator means comprises a Schmitt trigger whose inverting input is coupled to the output of said digital-to-analog converter means, and whose non-inverting input is coupled to said capacitor means.

10. Apparatus as in claim 8 wherein said discharging means comprises a transistor whose emitter-collector circuit is coupled in series between said capacitor means and ground potential, and whose base electrode is coupled to the output of said zero voltage crossing detector.

11. Apparatus as in claim 8 wherein said control means further includes a voltage divider means coupled between the output of said digital-to-analog converter means and said comparator means, said voltage divider means including manually operable means for selectively varying the magnitude of the analog signal.

12. Apparatus as in claim 7 wherein the random number generating means includes manually adjustable means for varying the rate at which the generating means produces digital signals.

13. Apparatus as in claim 12 wherein said manually adjustable means comprises a variable frequency oscillator for producing an oscillatory signal having a selectable frequency, and wherein said random numer generating means further includes a multi-stage shift register responsive to said oscillator for shifting its contents to produce a new digital signal with each oscillation of the oscllatory signal.

14. Apparatus as in claim 7 further including means for selectively decoupling said control means from said digital-to-analog converter means, and means for supplying a non-varying analog signal to said control means.

15. Apparatus as in claim 14 wherein said supplying means includes manually adjustable means for varying the magnitude of the analog signal supplied by the supplying means to the control means.

16. Apparatus for controlling the application of power from a D.C. source to a lamp to simulate the light output of a fire comprising random number generating means for successively producing digital signals which randomly vary in value, digital-to-analog converter means coupled to said random number generating means for producing an analog signal whose magnitude is generally proportional to the value of the digital signals produced by the random number generating means, lamp means for producing light when current is applied thereto, a switching device coupled in series with the lamp means and D.C. source for applying current to the lamp means in response to a received control signal, and control means for periodically applying a control signal to said switching device, the time during which said control signal is applied to the switching device being determined by the magnitude of said analog signal.

17. Apparatus as in claim 16 wherein said control means includes capacitor means coupled to said digital-to-analog converter means and chargeable by the analog signal, and logic means for applying a control signal to said switching device when the charge on the capacitor means falls to a first level, and for terminating application of the control signal to the switching device and draining charge from the capacitor means when the charge on the capacitor means reaches a second level above said first level, said logic means being adapted to terminate the draining of charge from the capacitor means when the charge on the capacitor means falls to said first level.

18. Apparatus as in claim 17 wherein said control means further includes manually adjustable means interconnecting said capacitor means and said logic means for varying the rate at which charge is drained from said capacitor means.

19. Apparatus as in claim 17 wherein said control means further includes manually adjustable means coupled to said digital-to-analog converter means for selectively varying the magnitude of the analog signal.

20. Apparatus as in claim 16 wherein said switching device comprises a transistor whose emitter-collector circuit is coupled in series with said lamp means and D.C. source, and whose base electrode is coupled to said control means.

* * * * *